United States Patent [19]

Lamb et al.

[11] 4,438,776

[45] Mar. 27, 1984

[54] CIGARETTE FILTER

[75] Inventors: Charles G. Lamb, Anchorage; Robert A. Sanford, Prospect, both of Ky.

[73] Assignee: Brown & Williamson Tobacco Corporation, Louisville, Ky.

[21] Appl. No.: 391,883

[22] Filed: Jun. 24, 1982

[51] Int. Cl.[3] ..... A24D 3/00; A24D 3/04

[52] U.S. Cl. ..... 131/336; 131/339; 131/340

[58] Field of Search ..... 131/336, 339, 340

[56] References Cited

U.S. PATENT DOCUMENTS

| | | | |
|---|---|---|---|
| 3,621,851 | 11/1971 | Heskett et al. | 131/339 |
| 3,752,165 | 8/1973 | Harlee et al. | 131/340 |
| 3,860,011 | 1/1975 | Norman | 131/336 |
| 3,910,288 | 10/1975 | Hammersmith et al. | 131/339 |
| 4,342,322 | 8/1982 | Sanford | 131/336 |
| 4,393,885 | 7/1983 | Silferstein | 131/339 |

*Primary Examiner*—V. Millin

*Attorney, Agent, or Firm*—Charles G. Lamb

[57] ABSTRACT

A filter for a cigarette includes a generally cylindrical permeable filter rod circumscribed by an air permeable tipping material with a plurality of blind-end channels formed in the filter rod, each of the channels being open at one end to the upstream end of the filter rod and extending therefrom, generally in the longitudinal direction of the filter rod, a predetermined distance less than the length of the filter rod.

6 Claims, 2 Drawing Figures

CIGARETTE FILTER

BACKGROUND OF THE INVENTION (a) Field of the Invention

The present invention relates to filters for cigarettes. In one respect it relates to an air ventilated filter. In another respect, the invention relates to a cigarette filter having a plurality of longitudinally extending air-smoke channels formed herein.

(b) Description of the Prior Art

It is well known in the art of cigarette filters to utilize ambient air for the dilution of cigarette smoke prior to entering the smoker's mouth. The dilution of the smoke stream reduces the concentration of smoke particulates as well as gas phase components which are delivered to the mouth of the smoker. A number of means have been proposed and are utilized for introducing ventilating air into the cigarette. For example, the wrapper for the tobacco column may be made of a porous material which allows for introduction of air along the entire length of the cigarette thereby mixing and diluting the smoke stream as it passes therethrough. Also, the cigarette wrapper may be perforated at selected locations along the length of the cigarette to provide ports through which ventilating air enters the cigarette. Even further, it is known to perforate the wrapper of a filter at the end of the cigarette to allow for ventilating air to enter the filter for dilution of the smoke stream in the filter. Examples are shown in U.S. Pat. No. 3,860,011 and U.S. Pat. No. 4,174,719. It has also been proposed to make cigarette filters wherein the ventilating air and the smoke stream pass through the filter in separate streams and do not mix until they exit the filter. Examples of this type of filter are shown in U.S. Pat. No. 3,324,862; U.S. Pat. No. 3,390,684; U.S. Pat. No. 4,023,576 and U.S. Pat. No. 4,256,122. Still further it has been suggested, for example, in U.S. Pat. No. 3,756,250, to fabricate a ventilated cigarette filter with a void at the upstream end of the filter which functions as an air-smoke mixing chamber. Even further, U.S. Pat. No. 4,135,523 shows a ventilated cigarette filter formed with a spiral groove formed in the periphery of the filter wherein air and smoke are mixed together.

SUMMARY OF THE INVENTION

In most cigarette filter constructions, the smoke leaves the mouth end of the filter in a concentrated stream from the center of the filter carrying the smoke to the back of the smoker's mouth missing most of the smoker's taste buds.

An object of the present invention is to provide a ventilated filter.

A further object of the present invention is to provide a cigarette filter which enhances the taste perceived by the smoke.

More particularly, the present invention provides a filter for a cigarette comprising a permeable filter rod of generally cylindrical configuration having an upstream end and a mouth end, means defining a plurality of blind-end channels in the filter rod, each of the channels being open at one end to the upstream end of the filter rod and extending therefrom in generally the longitudinal direction of the filter rod a predetermined distance less than the length of the filter rod, the closer a channel being to the perimeter of the filter rod the greater its predetermined extending distance, and filter wrapping material extending longitudinally of and circumscribing the filter rod, the wrapping material being air permeable to allow ambient ventilating air into the body of the filter rod and into the blind-end channels.

BRIEF DESCRIPTION OF THE DRAWINGS

The present invention will become even more clear upon reference to the following discussion and accompanying drawing in which like numerals refer to like parts and wherein.

DESCRIPTION OF THE PREFERRED EMBODIMENT

Figure 1:
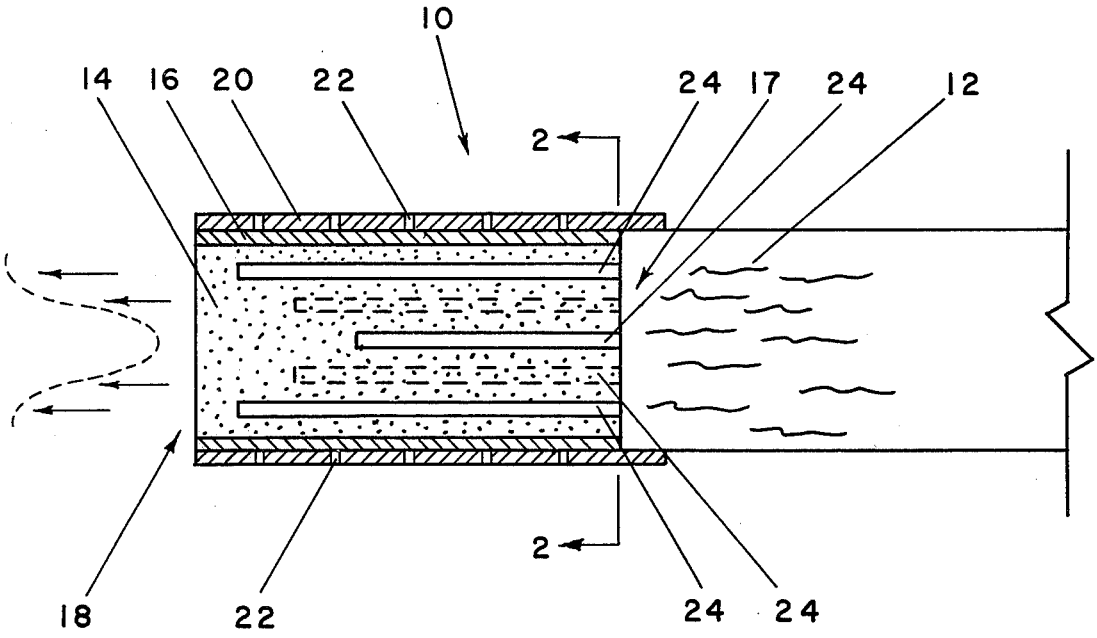
FIG. 1 is a longitudinal cross-sectional view, somewhat distorted to more clearly show details, of a cigarette including a filter having the features of the present invention.
Figure 2:
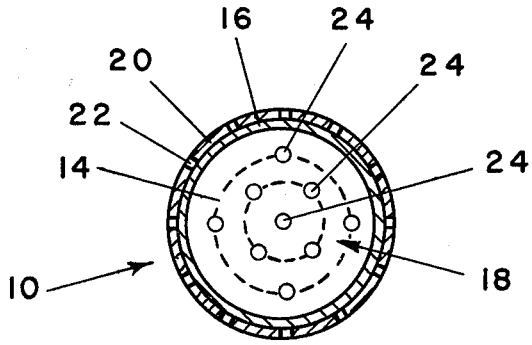
FIG. 2 is an end view of the filter as seen in the direction of arrows 2—2 in FIG. 1.

FIGS. 1 and 2 illustrate a cigarette filter, generally denoted as the number 10, incorporating the features of the present invention, attached to a tobacco column 12 to form a filtered cigarette.

The cigarette filter 10 is shown as comprising a generally cylindrically shaped filter rod 14 with a circumscribing permeable wrapper 16. The wrapper 16 extends longitudinally along the filter rod 14 from one end 17 (the upstream end) to the other end 18 (the mouth end) so that the filter rod ends 16 and 18 are in mutual flow-through relationship.

The filter rod 14 is fabricated of a porous material such as, for example, fiberous or foamed cellulose acetate, or any other suitable material. The wrapper 16 is generally commercially available filter plug wrap known for use with cigarette filter plugs.

As can be seen in FIG. 1, the wrapped filter rod is disposed in coaxial relationship to one end of the tobacco column 12 with the upstream end 17 in abutting relationship with one end of the tobacco column 12. The wrapped filter rod is attached to the tobacco column 12 with a tipping material 20 which circumscribes the wrapped filter rod and overlaps a portion of the tobacco column 12. The tipping material 20 is air permeable to provide for the flow of ambient ventilating air into the filter rod 14. The tipping material can be fabricated of a porous material, or as illustrated, it can be fabricated of a non-porous material formed with small air ventilation perforations 22.

Again with reference to FIGS. 1 and 2, the filter rod 14 includes a plurality of small diameter blind-end air-smoke mixing channels, generally denoted as the number 24, extending generally longitudinally of the filter rod 14. The channels 24 are open at the upstream end 17 of the filter rod 14 and extend therefrom, in a generally longitudinal direction of the filtr rod 14, a predetermined distance less than the length of the filter rod 14. As illustrated in FIG. 2, the channels 24 are generally arranged to lay on imaginary concentric circles (denoted by the broken circles in FIG. 2) which have as their center the longitudinal axis of the filter rod 14, with an additional channel 24 at the longitudinal axis of the filter rod 14. The channels 24 lying on adjacent imaginary circles are circumferentially off-set from one another. As can be best seen in FIG. 1, the predetermined length of the channels 24 is a function of the radial distance of a channel from the perimeter of the filter rod 14. In other words, those channels 24 near the perimeter of the filter rod 14 are longer than those other channels 24 which are located a greater radial distance from the perimeter of the filter rod 14. As shown in FIG. 1, those channels 24 lying on the outermost imaginary circle, and therefore which are closest to the perimeter of the filter rod 14, are longer than those channels lying on the smaller imaginary circle, and the channel 24 at the longitudinal axis of the filter rod 14 is the shortest of the channels. In addition, all of those channels 24 at the same radial distance from the perimeter of the filter rod 14 are of equal length. Thus, in the illustration of FIG. 1, the channels 24 lying on a common imaginary circle are of the same length.

When a cigarette having the filter 10 is smoked, a portion of the tobacco smoke enters the channels 24 through their open ends at the upstream end 17 of the filter rod 14, and another portion of the tobacco smoke enters the body of the filter rod 14 outside the channels 24. Concurrently, ventilating air enters the filter rod 14 through the ventilating air perforations 22 of the tipping material 20. As smoke flows in the channels 24 in a direction towards the mouth end 18 of the filter rod 14, some ventilating moves into the channels 24 and mixes with the smoke therein diluting and cooling it. The pressure drop across the filter rod 14 is greater through the body of the filter rod than through the channels 24, and the pressure drop through the shorter channels is greater than through the larger channels. Therefore, the velocity of the diluted smoke exiting the mouth end 18 of the filter rod 14 from the channels 24 will be greater than the velocity of the diluted smoke exiting the mouth end 18 of the filter rod 14 from the body of the filter rod 14. Likewise, the velocity of the diluted smoke exiting the mouth end 18 of the filter rod from the longer channels 24 will be greater than the velocity of the diluted smoke exiting the mouth end 18 of the filter rod 14 from the shorter channels 24. This coupled with the feature that those channels 24 closer to the perimeter of the filter rod 14 are longer than those channels 24 farther away from the filter rod perimeter provides a smoke velocity profile resembling that profile denoted by the dashed curved line and vector arrows at the mouth end 18 of the filter 10 in FIG. 1 wherein the velocity of the diluted smoke exiting the filter 10 progressively, or substantially uniformly, increases from the center of the filter rod radially outwardly toward the perimeter of the filter across the face of the filter.

Thus, more smoke leaves the filter and into the smoker's mouth in closer proximity to the smoker's "taste buds" thereby increasing the perceived taste to the smoker.

The foregoing detailed description is given primarily for clearness of understanding and no unnecessary limitations are to be understood therefrom for modifications will become obvious to those skilled in the art upon reading this disclosure and can be made without departing from the spirit of the invention and scope of the appended claims.

What is claimed is:

1. A filter for a cigarette comprising:

a permeable filter rod of generally cylindrical configuration having an upstream end and a mouth end;

means defining a plurality of blind-end channels in said filter rod, each of said channels being open at one end to the upstream end of said filter rod and extending therefrom in generally the longitudinally direction of said filter rod a predetermined distance less than the length of said filter rod, said channels being dispersed throughout the cross-sectional body of said filter rod the closer a channel being to the perimeter of said filter rod the greater its predetermined extending distance; and filter wrapping material extending longitudinally of and circumscribing said filter rod, said wrapping material being air permeable to allow ambient ventilating air into the body of said filter rod and into said blind-end channels.

2. The filter defined in claim 1, wherein those channels at the same radial distance from the perimeter of said filter rod extend an equal longitudinal distance from the upstream end of said filter rod.

3. The filter defined in claim 2, wherein said channels are generally arranged in concentric circular array.

4. The filter defined in claim 3, further comprising a channel located substantially at the longitudinal axis of said filter rod.

5. The filter defined in claim 3, wherein channels laying on adjacent circles are circumferentially off-set from one another.

6. The filter defined in claim 1, further comprising a permeable tipping material extending longitudinally of and circumscribing said filter rod and said wrapping material.

* * * * *